US008939263B2

(12) United States Patent
Tokura

(10) Patent No.: US 8,939,263 B2
(45) Date of Patent: Jan. 27, 2015

(54) ELEVATOR SYSTEM WITH ASSIGNED CAR CONFIRMATION

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 727 days.

(21) Appl. No.: 13/260,111

(22) PCT Filed: Jul. 15, 2009

(86) PCT No.: PCT/JP2009/062810

§ 371 (c)(1),
(2), (4) Date: Sep. 23, 2011

(87) PCT Pub. No.: WO2011/007428

PCT Pub. Date: Jan. 20, 2011

(65) Prior Publication Data

US 2012/0018257 A1 Jan. 26, 2012

(51) Int. Cl.

| | |
|---|---|
| ***B66B 1/18*** | (2006.01) |
| ***B66B 1/46*** | (2006.01) |
| ***B66B 1/24*** | (2006.01) |
| ***B66B 3/00*** | (2006.01) |

(52) U.S. Cl.

CPC ..... *B66B 1/468* (2013.01); *B66B 1/2458* (2013.01); *B66B 3/006* (2013.01); *B66B 2201/103* (2013.01); *B66B 2201/4615* (2013.01); *B66B 2201/4661* (2013.01); *B66B 2201/4676* (2013.01)

USPC ..... 187/382; 187/396; 187/391

(58) Field of Classification Search

USPC ..... 187/247, 380–388, 391, 392, 393

See application file for complete search history.

(56) References Cited

U.S. PATENT DOCUMENTS

| | | | | |
|---|---|---|---|---|
| 5,984,051 | A * | 11/1999 | Morgan et al. | 187/392 |
| 6,109,396 | A * | 8/2000 | Sirag et al. | 187/381 |
| 6,223,160 | B1 | 4/2001 | Kostka et al. | |
| 6,945,365 | B2 * | 9/2005 | Matela | 187/382 |
| 7,328,775 | B2 * | 2/2008 | Zaharia et al. | 187/396 |

(Continued)

FOREIGN PATENT DOCUMENTS

| | | |
|---|---|---|
| JP | 2001 2333 | 1/2001 |
| JP | 2004 142861 | 5/2004 |
| JP | 2006 117398 | 5/2006 |
| WO | 2006 043324 | 4/2006 |

OTHER PUBLICATIONS

Office Action issued Jun. 4, 2013 in Japanese Patent Application No. 2011-522653 (with English-language translation).

(Continued)

*Primary Examiner* — Anthony Salata

(74) *Attorney, Agent, or Firm* — Oblon, Spivak, McClelland, Maier & Neustadt, L.L.P.

(57) ABSTRACT

In an elevator system having a destination call registration device with which a user registers a destination call before boarding the elevator car and an assigned car confirming device with which a user makes sure of an assigned car by inputting his or her personal information when an elevator has been assigned to a destination call registered from the destination call registration device, information on an assigned car and personal information of a user are stored by associating these pieces of information with each other. An assigned car confirming device provides information on the assigned car to the user on the basis of the stored personal information.

1 Claim, 4 Drawing Sheets

(56) References Cited

U.S. PATENT DOCUMENTS

| | | | | |
|---|---|---|---|---|
| 7,353,915 | B2 * | 4/2008 | Zaharia et al. | 187/388 |
| 7,500,544 | B2 * | 3/2009 | Hakala et al. | 187/382 |
| 7,581,622 | B2 * | 9/2009 | Amano | 187/384 |
| 7,823,700 | B2 * | 11/2010 | Boss et al. | 187/384 |
| 7,921,968 | B2 * | 4/2011 | Stanley et al. | 187/388 |
| 8,028,806 | B2 * | 10/2011 | Stanley et al. | 187/387 |
| 8,061,485 | B2 * | 11/2011 | Finschi | 187/384 |
| 8,196,711 | B2 * | 6/2012 | Tokura | 187/382 |
| 8,505,692 | B2 * | 8/2013 | Tokura et al. | 187/382 |
| 2006/0065490 | A1 | 3/2006 | Zaharia et al. | |
| 2011/0048866 | A1 | 3/2011 | Tokura | |
| 2011/0132699 | A1 | 6/2011 | Tokura et al. | |
| 2011/0174580 | A1 | 7/2011 | Tokura | |

OTHER PUBLICATIONS

Office Action issued on Mar. 18, 2013 in the corresponding Korean Patent Application No. 10-2011-7027592 (with English Translation).

English Translation of International Preliminary Report on Patentability and Written Opinion issued Feb. 16, 2012 in PCT/JP2009/062810.

Combined Chinese Office Action and Search Report issued Sep. 13, 2013 in Patent Application No. 200980160347.X (with English language translation).

International Search Report issued Feb. 9, 2010 in PCT/JP09/062810 filed Jul. 15, 2009.

* cited by examiner

| ID NUMBER | ASSIGNED ELEVATOR NO. |
|---|---|
| 0000058 | A |
| 0000492 | A |
| 0000267 | C |
| 0000127 | B |
| 0000984 | A |
| ⋮ | ⋮ |

ELEVATOR SYSTEM WITH ASSIGNED CAR CONFIRMATION

TECHNICAL FIELD

The present invention relates to an elevator system which group-controls a plurality of elevators and with which a user can register a destination call (destination floor) before boarding an elevator car.

Background Art

In buildings and the like where there are many elevator users, a plurality of elevators are installed within the same building and these plurality of elevators are group-controlled in order to improve the operation efficiency of all elevators.

As such elevator systems, there have been proposed elevator systems which are configured to ensure that users can register their destination calls (destination floors) before boarding elevator cars (refer to Patent Documents 1 and 2, for example).

Specifically, in the elevator system described in Patent Document 1, a reader for reading information of ID cards is installed in an elevator hall, whereby destination calls are automatically registered on the basis of the card information read by the reader. In this elevator system, an indication device is installed in the hall and each time a destination call is registered, an elevator No. assigned to the destination call (a car to be boarded by the user) is indicated in the indication device.

On the other hand, in the elevator system described in Patent Document 2, a user inputs his or her personal information through the use of an ID card or the like in passing through a security gate, whereby a destination call is automatically registered on the basis of the inputted personal information. An indication device is installed in an elevator hall, and the indication device is caused to indicate the destination floor of each elevator.

Patent Document 1: Japanese Patent Laid-Open No. 2006-117398

Patent Document 2: International Publication No. WO2006/043324

DISCLOSURE OF THE INVENTION

Problems to be Solved by the Invention

In the elevator systems described in Patent Documents 1 and 2, it could not be said that the indication devices installed in elevator halls and the like fulfill sufficient functions.

That is, in an elevator system which is such that each time a destination call is registered, the assigned elevator No. is indicated on an indication device, as described in Patent Document 1, once the indication disappeared from the indication device, thereafter the user could not make sure of the elevator car to board. For example, in the case where the above-described reader is installed in a place away from the hall, a user sometimes forgot the elevator No. assigned to him or her during movement to the hall and in such a case, this imposed an inconvenience on the user.

On the other hand, in the case where destination floors for each elevator are only indicated on an indication device, there was a concern that a user may board a wrong elevator car. In particular, as in the elevator system described in Patent Document 2, when the elevator system involves inputting personal information at the time of the registration of destination calls, the system may sometimes has a special function using the personal information. For example, Patent Document 2 discloses performing special operations, such as operation for females alone, operation for physically-handicapped people, and operation for VIPs, by using the personal information read when users pass through a security gate. In such a case, when a user boards an elevator car by looking at only destination floors indicated on an indication device, there was a concern that other users who pass through the security gate in the same period of time may erroneously board the elevator car for which a special operation is to be performed.

The present invention was made to solve the problems described above, and an object of the invention is to provide an elevator system, in which a user registers a destination call by inputting his or her personal information before boarding an elevator car, which can appropriately provide information on an assigned car and enables the user to easily make sure of the elevator car to board even after registering a destination call.

Means for Solving the Problems

An elevator system of the present invention is an elevator system which group-controls a plurality of elevators. The elevator system comprises a destination call registration device with which a user registers a destination call by inputting his or her personal information before boarding an elevator car, assignment means which, upon registration of a destination call from the destination call registration device, assigns an optimum elevator to the registered destination call from the plurality of elevators, storage means which, upon assignment of an elevator to a destination call by the assignment means, stores information on an assigned car and personal information of a user by associating these pieces of information with each other regarding the destination call for which the assignment has been performed, and an assigned car confirming device which, upon input of personal information of a user, provides information on an assigned car of the user on the basis of the inputted personal information and the memory content in the storage means.

An elevator system of the present invention is an elevator system which group-controls a plurality of elevators. The elevator system comprises a destination call registration device which has input means with which a user inputs his or her personal information and notification means for providing prescribed information, and with which a user registers a destination call by inputting his or her personal information from the input means before boarding an elevator car, assignment means which, upon registration of a destination call from the destination call registration device, assigns an optimum elevator to the registered destination call from the plurality of elevators, and storage means which, upon assignment of an elevator to a destination call by the assignment means, stores information on an assigned car and personal information of a user by associating these pieces of information with each other regarding the destination call for which the assignment has been performed. The destination call registration device, upon input of personal information of a user from the input means, does not perform registration of a new destination call if an elevator has already been assigned to the destination call of the user, and causes the notification means to provide information on the assigned car of the user on the basis of the personal information inputted from the input means and the memory content in the storage means.

Effect of the Invention

According to the present invention, in an elevator system in which a user registers a destination call by inputting his or her personal information before boarding an elevator car, it is ensured that appropriate information on an assigned car can be provided, and that the user is able to easily make sure of the elevator car to board even after the registration of a destination call.

BRIEF OF DESCRIPTION OF THE DRAWINGS

DESCRIPTION OF SYMBOLS

1 destination call registration device,
2 ID recognition means,
3 destination call registration means,
4 assigned car notification means,
5 group supervisory controller, 6 assignment means,
7 storage means, 8 assignment control section,
9 individual elevator controller, 10 car control means,
11 assigned car confirming device,
12 ID recognition means,
13 assigned car confirmation means,
14 assigned car notification means
15 destination call registration device,
16 ID recognition means,
17 assigned car notification means,
18 determination means,
19 destination call registration means,
20 assigned car confirmation means

BEST MODE FOR CARRYING OUT THE INVENTION

The present invention will be described in more detail with reference to the accompanying drawings. Incidentally, in each of the drawings, like numerals refer to like or corresponding parts and redundant descriptions of these parts are appropriately simplified or omitted.

First Embodiment

Figure 1:
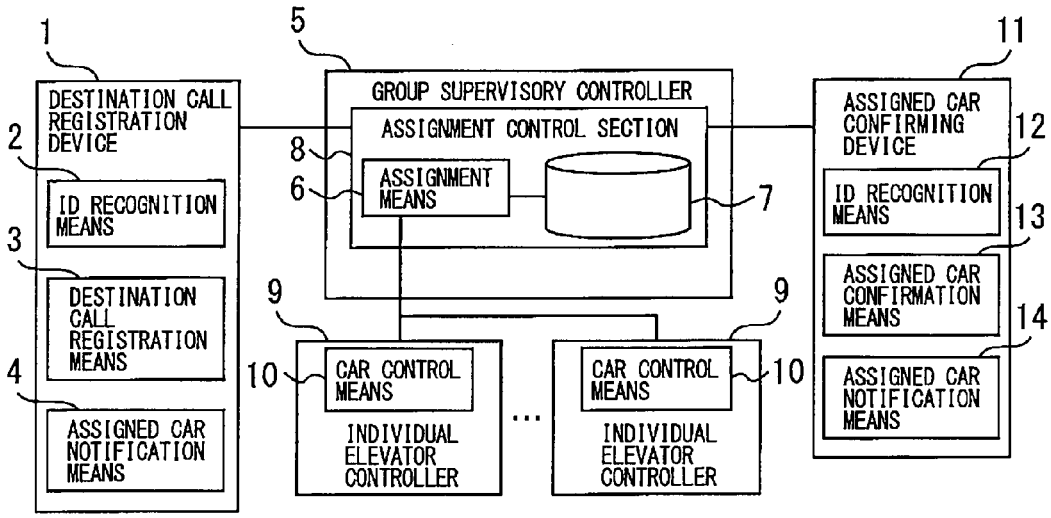
FIG. 1 is a block diagram showing an elevator system in a first embodiment according to the present invention.
Figure 2:
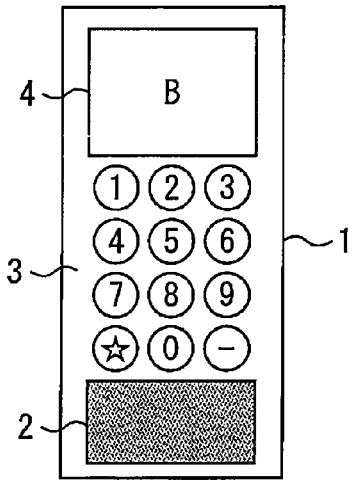
FIG. 2 is a front view showing a destination call registration device.
Figures 3, 4:
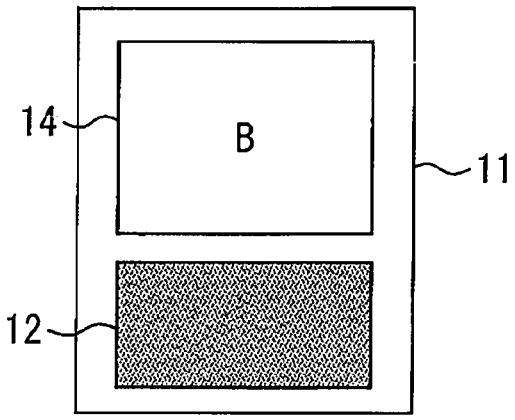
FIG. 3 is a diagram to explain the details of assignment data.
FIG. 4 is a front view showing an assigned car confirming device.

FIG. 1 is a block diagram showing an elevator system in a first embodiment according to the present invention; FIG. 2 is a front view showing a destination call registration device; FIG. 3 is a diagram to explain the details of assignment data; and FIG. 4 is a front view showing an assigned car confirming device.

In FIGS. 1 to 4, reference numeral 1 denotes a destination call registration device with which a user registers a destination call (destination floor) before boarding an elevator car. This destination call registration device 1 is installed, for example, in an elevator hall, a passage leading to a hall, and a security gate and the like through which a user inevitably must pass in moving to a hall.

This destination call registration device 1 requires a user to input his or her personal information, such as an ID number, in registering a destination call. In order to realize this function, the destination call registration device 1 is provided with ID recognition means 2, destination call registration means 3, and assigned car notification means 4.

The ID recognition means 2 has the function with which a user inputs his or her personal information upon registering a destination call and the function of reading inputted personal information. The ID recognition means 2 is, for example, a reader (card reader or the like) which reads personal information from a key, a card, an IC tag or the like. This ID recognition means 2 may be an authentication device which reads biometric information (personal information), such as a fingerprint, a voiceprint, or an iris pattern, or may be a numerical keypad or the like for inputting personal identification numbers.

The destination call registration means 3 has the function of registering a destination call of a user who has inputted his or her personal information. The destination call registration means 3 is, for example, a numerical keypad which permit a destination floor to be inputted when the ID recognition means 2 has recognized an ID number. This destination call registration means 3 may be a device which automatically registers a destination call through the input of personal information by a user. In such a case, for example, when the personal information read by the above-described reader, the authentication device or the like is in agreement with the information which has already been registered, the destination call registration means 3 determines the destination floor of the user on the basis of the information which has already been registered, and automatically registers the destination call. Furthermore, the destination call registration means 3 may be a device which normally performs the automatic registration of a destination call by the authentication of an ID number or by other means, and upon operation of a numerical keypad after the input of an ID number, preferentially registers a destination call inputted from the numerical keypad.

The assigned car notification means 4 has the function of providing information on the assigned car to the outside when an elevator has been assigned to a destination call registered by the destination call registration means 3. The assigned car notification means 4 is composed of, for example, a display for indicating information on an assigned car and a control section which controls the indication. Incidentally, it is necessary only that the assigned car notification means 4 have the function of providing information on an assigned car to an operator of the destination call registration device 1 (an elevator user), and the assigned car notification means 4 may be provided with a speaker, a lamp or the like in place of the above-described display. In such a case, the assigned car notification means 4 provided information on an assigned car by audio guidance or lamp indication.

Reference numeral 5 denotes a group supervisory controller which controls a plurality of elevators installed in the same building and the like as a group. Incidentally, a group of elevators controlled by the group supervisory controller 5 may be all of the elevators installed in a building or may be part of the elevators installed in the building.

Specifically, the group supervisory controller 5 has an assignment control section 8 composed of assignment means 6 and storage means 7.

The assignment means 6 has the function of assigning an optimum elevator from the above-described plurality of elevators to a destination call when this destination call has been registered from the destination call registration device 1.

The storage means 7 has the function of storing information on an assigned car and personal information of a user by associating these pieces of information with each other upon assignment of an elevator to a destination call by the assignment means 6, regarding the destination call for which the assignment has been performed. Specifically, when an assignment to a destination call has been performed by the assignment means 6, the storage means 7 associates information on the assigned car to the destination call and an ID number (personal information) of a user, which has been inputted in the ID recognition means 2 upon registering the destination call, with each other as a set of data, and stores these pieces of information as assignment data. Incidentally, FIG. 3 shows an example of this assignment data.

Reference numeral 9 denotes an individual elevator controller for controlling each of the elevators which are group-controlled by the group supervisory controller 5. The individual elevator controller 9 is provided with car control means 10, which controls a car, and the like. On the basis of various kinds of operation instructions received from the group supervisory controller 5, the individual elevator controller 9 controls the operation of each of the elevators appropriately.

An assigned car confirming device 11 is intended to be used by an elevator user who has registered a destination call in confirming the elevator assigned to the user (assigned car) before boarding the elevator car. This assigned car confirming device 11 is provided separately from the destination call registration device 1 and is installed, for example, in an elevator hall. Incidentally, the assigned car confirming device 11 and the destination call registration device 1 may be installed side by side in an elevator hall.

The above-described assigned car confirming device 11 requires a user to input the same personal information as the personal information inputted to the destination call registration device 1 upon registering a destination call as a precondition for providing information on an assigned car. When personal information of a user has been inputted, on the basis of the inputted personal information and the memory content of the storage means 7, the assigned car confirming device 11 provides information on the assigned car of the user. In order to realize such a function, the assigned car confirming device 11 is provided with ID recognition means 12, assigned car confirmation means 13, and assigned car notification means 14.

The ID recognition means 12 has the function with which a user inputs his or her personal information and the function of reading inputted personal information. This ID recognition means 12 is configured to be able to read the same personal information as the personal information read by the above-described ID recognition means 2.

The assigned car confirmation means 13 has the function of identifying an assigned car of a user when the personal information of the user has been inputted to the assigned car confirming device 11, and providing the information on the assigned car to the outside. Specifically, the assigned car confirmation means 13 obtains, from the storage means 7, the information on an assigned car stored by being associated with an inputted ID number when the ID number has been inputted to the ID recognition means 12. On the basis of the obtained information, the assigned car confirmation means 13 causes the above-described assigned car notification means 14 to provide information on the assigned car of the user who has inputted his or her ID number.

The concrete processing for identifying the above-described assigned car of the user may be performed on the group supervisory controller 5 side. Furthermore, it is only necessary that the above-described assigned car notification means 14 have the function of providing the information on an assigned car to the outside, and the assigned car notification means 14 is composed of, for example, a notification device, such as a display, a speaker or a lamp, and a control function section thereof.

Incidentally, the above-described destination call registration device 1, group supervisory controller 5, individual elevator controller 9, and assigned car confirming device 11 are each connected through a network and are configured to be able to perform information communication mutually.

Figure 5:
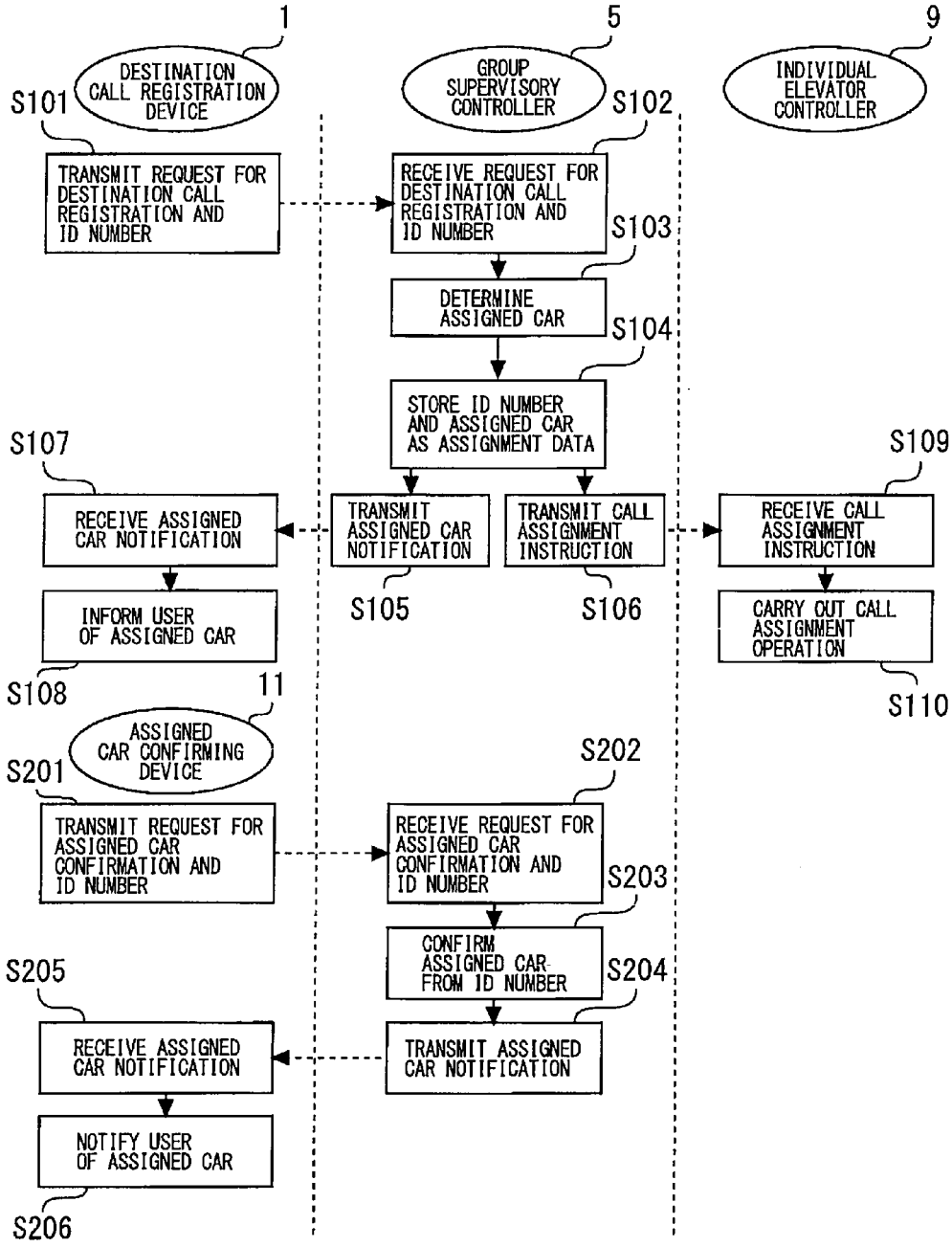
FIG. 5 is a flowchart showing the operation of the elevator system in the first embodiment according to the present invention.

Next also referring to FIG. 5, a concrete operation of the elevator system having the above-described configuration will be described. FIG. 5 is a flowchart showing the operation of the elevator system in the first embodiment according to the present invention.

When an elevator user registers a destination call before boarding an elevator car by inputting his or her ID number from the ID recognition means 2, a request for a destination call registration and the above-described inputted ID number are transmitted from the destination call registration device 1 to the group supervisory controller 5 (S101).

Upon receipt of the request for a destination call registration and the corresponding ID number from the destination call registration device 1 (S102), first, the group supervisory controller 5 determines an optimum assigned car for the received request for a destination call registration through the use of the assignment means 6 (S103). When the group supervisory controller 5 has determined an assigned car to the destination call, the group supervisory controller 5 stores the information on the assigned car and the ID number received in S102 as assignment data in the storage means 7 (S104). That is, by this processing in S104, the information on the assigned car and the ID number corresponding to one destination call are retained as one set of data associated with each other. After the processing in S104 (or in parallel with the processing in S104), the group supervisory controller 5 transmits an assigned car notification to the destination call registration device 1 (S105). Similarly, the group supervisory controller 5 transmits a call assignment instruction to the individual elevator controller 9 to which the assignment of the destination call has been performed (S106).

Upon receipt of the assigned car notification from the group supervisory controller 5 (S107), the destination call registration device 1 in which the destination call registration has been performed, performs a screen indication or other operations through the use of the assigned car notification means 4 to notify the user who has registered the destination call of the assigned car (S108).

Upon receipt of the call assignment instruction from the group supervisory controller 5 (S109), the individual elevator controller 9 of an elevator for which the destination call assignment has been performed, carries out an appropriate call assignment operation suited to the received content (S110). That is, the above-described individual elevator controller 9 causes the elevator car to make a stop at the hall of the floor for which a destination call registration has been performed in order that the user can board the elevator, and thereafter causes the elevator car to run to the destination floor of the user, where the user is allowed to get out of the elevator car.

On the other hand, when a user inputs his or her ID number from the ID recognition means 12 in order to make sure of the elevator car to be boarded by the user, a request for an assigned car confirmation and the above-described inputted ID number are transmitted from the assigned car confirming device 11 to the group supervisory controller 5 (S201).

Upon receipt of the request for an assignment car confirmation and the corresponding ID number from the assigned car confirming device 11 (S202), the group supervisory controller 5 retrieves the assignment data stored in the storage means 7 and identifies the assigned car information stored by being associated with the received ID number (S203). After the confirmation of the assigned car corresponding to the relevant ID number, the group supervisory controller 5 transmits the assigned car notification to the assigned car confirming device 11 (S204).

Upon receipt of the assigned car notification from the group supervisory controller 5 (S205), the assigned car confirming device 11 for which an ID number input has been performed notifies the user who has performed an ID number input of the assigned car by causing the assigned car notification means 14 to perform a screen indication or other operations (S206).

According to the first embodiment of the present invention, in an elevator system in which a user registers a destination call by inputting his or her personal information before boarding an elevator car, it is possible to appropriately provide information on an assigned car, and the user is able to easily make sure of the elevator car to board even after the registration of a destination call. For example, even in the case where the destination call registration device 1 is installed in a place away from an elevator hall, a user in the hall can easily make sure of the elevator car to board.

Incidentally, it is only necessary that the confirmation of an assigned car by the assigned car confirming device 11 be performed during the time when an elevator is being assigned to a destination call, that is, only in the duration from the time when an assignment by the assignment means 6 was performed to the time when the elevator responds to the destination call. For this reason, for the destination call to which the elevator has responded, for example, the assignment data may be deleted from the storage means 7. In such a case, if the information on an assigned car corresponding to an ID number is not stored in the storage means 7, the assigned car confirmation means 13 causes the assigned car notification means 14 to provide information to that effect, for example.

Incidentally, during the period in which an assigned car is capable of being confirmed by the assigned car confirming device 11, it is possible to appropriately set the period as a duration to the time when a car has arrived at the floor where a user is to board an elevator car, a duration to the time when the door of an elevator is totally closed at the floor where a user is to board the elevator car, a duration to the time when an elevator has started running from the floor where a user is to board the elevator car to a destination floor, or the like.

Second Embodiment

Figure 6:
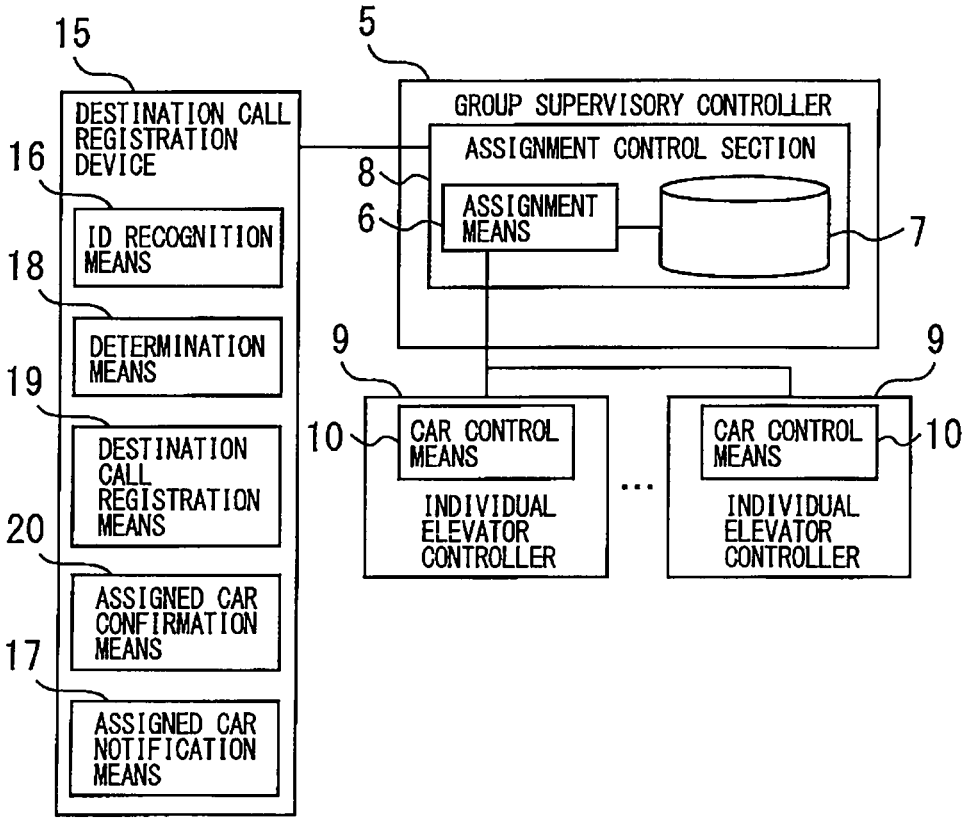
FIG. 6 is a block diagram showing an elevator system in a second embodiment according to the present invention.

FIG. 6 is a block diagram showing an elevator system in a second embodiment according to the present invention.

In the first embodiment, the description was given of the case where an elevator user performs the registration of a destination call and the confirmation of an assigned car by using different devices. In this embodiment, a description will be given of the case where a user performs the registration of a destination call and the confirmation of an assigned car by using the same (one) device.

In FIG. 6, a destination call registration device 15 combines the function of the destination call registration device 1 and the function of the assigned car confirming device 11 in the first embodiment. That is, an elevator user can perform both the registration of a destination call and the confirmation of an assigned car by inputting his or her personal information in the destination call registration device 15. Specifically, the destination call registration device 15 performs the registration of a destination call, upon the input of the personal information of a user, if no elevator has been assigned to the destination call of the user. On the other hand, in the case where upon input of the personal information of a user, an elevator has already been assigned to the destination call of the user, the destination call registration device 15 does not perform the registration of a new destination call, and provides information on the assigned car of the user on the basis of the inputted personal information and the memory content of the storage means 7.

In order to realize the above-described functions, the destination call registration device 15 is provided with ID recognition means 16, assigned car notification means 17, determination means 18, destination call registration means 19, and assigned car confirmation means 20. Incidentally, the above-described ID recognition means 16, assigned car notification means 17, destination call registration means 19, and assigned car confirmation means 20 have each a function substantially the same as the means 2, 4, 3, and 13 in the first embodiment.

The determination means 18 has the function of making a determination as to whether or not an elevator has been assigned to a destination call of a user upon input of an ID number (personal information) to the ID recognition means 16. Specifically, the determination means 18 makes the above-described determination depending on whether or not an assigned car corresponding to the ID number of the user is stored in the storage means 7.

In the case where an assigned car corresponding to the ID number of the user has already been stored in the storage means 7, the determination means 18 determines that an assignment to the destination call of the user has already been performed, and causes the assigned car confirmation means 20 to operate. That is, on the basis of the inputted personal information and the memory content of the storage means 7, the assigned car confirmation means 20 causes the assigned car notification means 17 to notify the user of the assigned car of the user.

On the other hand, in the case where an assigned car corresponding to the ID number of the user has not been stored in the storage means 7, the determination means 18 determines that an assignment to the destination call of the user has not been performed as yet, and causes the destination call registration means 19 to operate, thereby causing the destination call registration means 19 to register the destination call of the user. That is, a request for a destination call registration and the above-described inputted ID number are transmitted from the destination call registration device 1 to the group supervisory controller 5, and the assignment by the assignment means 6 is performed. When an assigned car to the above-described destination call has been determined, assignment data is stored in the storage means 7, an assigned car notification is transmitted to the destination call registration device 15, and information on the assigned car is provided by the assigned car notification means 17.

According to the second embodiment of the present invention, the destination call registration device 15 has the function of providing information on an assigned car while an elevator is being assigned to a destination call, i.e., in the duration from the time when an assignment by the assignment means 6 is performed to the time when an elevator responds to the destination call, and has the function of registering a destination call in other periods. For this reason, it is unnecessary to install different pieces of equipment for each of the above-described functions in an elevator hall, enabling the system to be simplified. Furthermore, it is possible to improve the design of an elevator hall.

It is also possible to install a destination call registration device 15 of the above-described configuration in an elevator hall and to install the destination call registration device 1 described in the first embodiment in a place away from the elevator hall.

In other respects, the elevator system of the second embodiment has the same configuration and effect as that of the first embodiment.

Industrial Applicability

The elevator system according to the present invention can be applied to an elevator system which group-controls a plurality of elevators and with which a user registers a destination call by inputting his or her personal information before boarding an elevator car.

The invention claimed is:

1. An elevator system which group-controls a plurality of elevators, comprising:

a destination call registration device with which a user registers a destination call by inputting his or her personal information before boarding an elevator car;

an assignment section which, upon registration of a destination call from the destination call registration device, assigns an optimum elevator to the registered destination call from the plurality of elevators;

a storage section which, upon assignment of an elevator to a destination call by the assignment section, stores information on an assigned car and personal information of a user by associating these pieces of information with each other regarding the destination call for which the assignment has been performed; and an assigned car confirming device which, upon input of personal information of a user, provides information on an assigned car of the user on the basis of the inputted personal information and the memory content in the storage section, wherein the destination call registration device comprises:

a first input section with which a user inputs his or her personal information upon registering a destination call; and a first notification section which, upon assignment of an elevator to a destination call by the assignment section, provides information on an assigned car for the destination call, and the assigned car confirming device comprises:

a second input section with which a user inputs his or her personal information;

a second notification section for providing prescribed information; and an assigned car confirmation section which, upon input of personal information of a user to the second input section, obtains the information on an assigned car stored by being associated with the inputted personal information from the storage section, and causes the second notification section to provide information on the assigned car to the user.

* * * * *